US011434943B2

(12) United States Patent
Le Brun et al.

(10) Patent No.: US 11,434,943 B2
(45) Date of Patent: Sep. 6, 2022

(54) METHOD FOR CONTROL OF A CYLINDER

(71) Applicant: SAFRAN AIRCRAFT ENGINES, Paris (FR)

(72) Inventors: Christophe Marc Alexandre Le Brun, Moissy-Cramayel (FR); Charles Ying, Moissy-Cramayel (FR); Alexis Ferrer Belloti Cardin, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 17/296,491

(22) PCT Filed: Nov. 26, 2019

(86) PCT No.: PCT/FR2019/052811

§ 371 (c)(1),
(2) Date: May 24, 2021

(87) PCT Pub. No.: WO2020/115400

PCT Pub. Date: Jun. 11, 2020

(65) Prior Publication Data

US 2022/0034336 A1 Feb. 3, 2022

(30) Foreign Application Priority Data

Dec. 7, 2018 (FR) ..... 1872531

(51) Int. Cl.
*F15B 19/00* (2006.01)

(52) U.S. Cl.
CPC ..... *F15B 19/005* (2013.01); *F15B 19/007* (2013.01); *F15B 2211/6336* (2013.01); *F15B 2211/857* (2013.01); *F15B 2211/8757* (2013.01)

(58) Field of Classification Search
CPC ..... F15B 19/004; F15B 19/007; F15B 2211/6336; F15B 2211/857
See application file for complete search history.

(56) References Cited

U.S. PATENT DOCUMENTS

2016/0025114 A1* 1/2016 Perkins ..... F15B 15/22 91/51
2021/0372521 A1* 12/2021 Weinhardt ..... F15B 19/005

FOREIGN PATENT DOCUMENTS

DE 10318171 A1 11/2004
EP 0526418 A1 2/1993
EP 2228545 A2 9/2010

OTHER PUBLICATIONS

French Search Report in FR Application No. 1872531, dated Aug. 21, 2019, (2 pages).

(Continued)

*Primary Examiner* — Thomas E Lazo
*Assistant Examiner* — Daniel S Collins
(74) *Attorney, Agent, or Firm* — Bookoff McAndrews, PLLC.

(57) ABSTRACT

A method for controlling a cylinder includes providing a cylinder having a piston, a servo valve and a measuring device having at least one first position sensor and one second position sensor, measurements are taken of the position of the piston in the cylinder body simultaneously with the first position sensor and the second position sensor, at least one first displacement speed of the piston is determined on the basis of the piston position measurements obtained with the first position sensor, at least one second displacement speed of the piston is determined on the basis of the piston position measurements obtained with the second position sensor, and each of the first and second determined displacement speeds of the piston are compared with a modelled or predetermined displacement speed of the (Continued)

piston, in such a way as to identify the most reliable position sensor.

14 Claims, 2 Drawing Sheets

(56) References Cited

OTHER PUBLICATIONS

International Search Report issued in International Application No. PCT/FR2019/052811, dated May 25, 2020 (2 pages).

* cited by examiner

METHOD FOR CONTROL OF A CYLINDER

CROSS-REFERENCE TO RELATED APPLICATION(S)

This application is the U.S. national phase entry under 35 U.S.C. § 371 of International Application No. PCT/FR2019/052811, filed on Dec. 26, 2019, which claims priority to French Patent Application No. 1872531, filed on Dec. 7, 2018.

TECHNICAL FIELD

This invention relates to the field of the control of cylinders, and particularly cylinders used to actuate the movable members of a variable-geometry turbomachine.

In the field of aeronautics, the turbomachines of aircraft comprise members called "variable-geometry" members. A variable geometry of a turbomachine such as a turbojet engine is a movable member, the position of which can be controlled to act on the flow of a fluid through the turbojet engine, for example on the gas stream in the primary flow path of a twin spool turbojet engine, in order to control the behavior of the turbojet engine. Variable geometries may for example be valves or movable blades, such as VBV (Variable Bleed Valve) or stator blading with variable shimming. The valves may also be valves for adjusting the flow rate of the air for cooling the turbine casings, in a system for adjusting the clearance at the tips of the turbine blades by heat-shrinking the casings, in order to optimize fuel consumption.

PRIOR ART

Cylinders conventionally comprise a piston translationally movable inside a cylinder body. Cylinders are known equipped with position sensors and controlled by servo valves, in order to slave the position of the piston in the body of said cylinder. Such an assembly formed by a cylinder, a servo valve and a plurality of position sensors is also called a servo actuator. The servo valve forms a member for controlling the cylinder, for example configured to regulate the pressure or flow rate of the fluid supplying said cylinder, in order to regulate the position of the piston in the cylinder body.

It is known to use measuring devices in order to measure the position of the piston in the cylinder body. Said measuring devices conventionally comprise, and for safety reasons, two redundant position sensors configured to simultaneously and independently of one another. The position of the piston in the cylinder body is then generally regulated on the basis of an average of the position measurements supplied by the two position sensors.

One drawback of this type of method is that in the event of faults or incorrect adjustment of one of the two position sensors causing drifts or offsets in amplitude, the slaving of the position of the piston in the cylinder body is disrupted, even in cases in which said average is only slightly affected. Consequently, the position of the piston in the cylinder body is not accurately regulated. Thus, when the actuator is used to actuate variable geometries of a turbomachine such as for example VSVs (Variable Stator Valves) which are blades with variable shimming in a stator blading (known as the straightener) of a high-pressure compressor, this causes disruption in the control of said blades which have the shape of winglets, risking damage to them, particularly due to the risk of the compressor initiating a surge. The control of the turbomachine itself is also disrupted by the control deficit of the VSVs or else the VBVs, risking Loss of Thrust Control, which is not desirable.

SUMMARY OF THE INVENTION

One aim of the present invention is to make provision for a method for controlling a cylinder remedying the aforementioned problems.

To do this, the invention relates to a method for controlling a cylinder, comprising steps in which:

- a cylinder is provided comprising a cylinder body and a piston translationally movable inside the cylinder body;
- a servo valve is provided, configured to regulate the power supplied to said cylinder, in such a way as to control the position of the piston in the cylinder body;
- a measuring device is provided having at least one first position sensor and one second position sensor;
- measurements are taken of the position of the piston in the cylinder body simultaneously with the first position sensor and the second position sensor;
- at least one first displacement speed of the piston is determined on the basis of the piston position measurements obtained with the first position sensor:
- at least one second displacement speed of the piston is determined on the basis of the piston position measurements obtained with the second position sensor; and
- each of the first and second determined displacement speeds of the piston are compared with a modelled or predetermined displacement speed of the piston, in such a way as to identify the most reliable position sensor.

Without limitation, the cylinder may be a pneumatic or hydraulic cylinder and is preferably a double-acting cylinder. Still without limitation, the cylinder may be used to actuate blades with variable shimming in the stator blading of a high-pressure compressor of a turbomachine.

The servo valve controls the supplying of the cylinder, for example with fluid, on the basis of an electronic control signal that it receives as input, in order to control the displacement of the piston in the cylinder body and to regulate the position of said piston.

Each of the position sensors forms a separate measuring member. Without limitation, these may be inductive or magnetic position sensors. These position sensors may be electronic passive linear displacement sensors (or LVDT, for Linear Variable Differential Transformer).

The assembly formed by the cylinder, the servo valve and the measuring device forms a servo actuator making it possible to slave the position of the cylinder inside the cylinder body. In other words, the position of the cylinder is corrected on the basis of the position measurements provided by the sensors and a piston position setpoint.

The first and second position sensors are identical and placed under similar measuring conditions in order to take the piston position measurements. These measurements are taken at the same time. Also, under normal operation of the two position sensors, the position measurements they provide are substantially identical.

The modelled or predetermined speed serves as a reference and is considered as being the actual and exact speed of the piston, which would be measured by a perfect position sensor.

The term "most reliable position sensor" is understood to mean the position sensor, the position measurements of which are the most accurate and the most consistent with the actual position of the piston in the cylinder body. The most reliable position sensor is the one providing position measurements making it possible to determine a piston displacement speed that is the closest to the modelled or predetermined displacement speed.

In order to compare them, the first and second displacement speeds and the modelled or predetermined displacement speed of the piston are advantageously considered under similar operating conditions, for example in response to a control signal of the given servo valve.

The method according to the invention makes it possible to identify the most reliable position sensor quickly, accurately and with a minimum of measurements taken. It is then possible to regulate the position of the piston on the basis of the position measurements supplied by said position sensor identified as being the most reliable. The slaving of the piston position is therefore improved by comparison with methods of the prior art in which the piston position is regulated on the basis of an average of the position measurements of the two position sensors.

The position of the piston is more accurately controlled such that the method according to the invention reduces the risk of damaging at least one variable geometry actuated by the cylinder in the turbomachine. The method according to the invention also makes it possible to dispense with Loss of Thrust Control.

Another benefit of the method according to the invention is that it can be used to target one malfunctioning position sensor out of the two position sensors, in order to refrain from regulating the position of the piston on the basis of the position measurements supplied by this malfunctioning sensor and where applicable to replace it.

The identification of the malfunctioning position sensor can also assist maintenance and thus saves a substantial amount of time, since there is no longer any need to troubleshoot by other means.

In the variant in which the first and second displacement speeds of the piston are compared with a modeled displacement speed of the piston, said modeled displacement speed of the piston is preferably determined on the basis of a pre-established model of operation of the assembly formed by the servo valve and the cylinder. This model is considered as expressing the normal, incident-free operation of this assembly. This piston speed model in particular has the advantage of being very accurate and easy to implement, and in particular much more accurate and easy to implement than cylinder piston position models.

Specifically, the assembly formed by the servo valve and the cylinder behaves like an integrator. It is also difficult to estimate the position of the piston on the basis of a position model and to compare measured positions with such a modeled position. The comparison of the piston displacement speeds, obtained on the basis of position measurements, with a modeled displacement speed is easier.

The use of a modelled speed therefore makes it possible to identify the most reliable position sensor more quickly and effectively.

In the variant in which the first and second displacement speeds of the piston are compared with a predetermined displacement speed of the piston, said predetermined displacement speed can be extracted from a table of characteristic values of piston displacement speed, for example under normal operating conditions. This predetermined displacement speed can be stored in an internal memory of the measuring device.

Preferably, the steps of determining the first and second displacement speeds of the piston are repeated over a chosen period in such a way as to determine a plurality of first and second displacement speeds of the piston. The set of first and second displacement speeds of the piston thus determined are then compared with a plurality of modeled or predetermined displacement speeds of the piston.

Preferably, the comparison of said first and second determined displacement speeds of the piston with said predetermined or modeled displacement speed of the piston comprises a step of computing a comparison factor R and determining the sign of said comparison factor. Without limitation, a positive comparison factor indicates that the first position sensor is more reliable and a negative comparison factor indicates that the second position sensor is the most reliable or conversely.

Preferably, the comparison factor R is computed according to the following equation:

$$R=\int|v_1-v_{mod}|-\int|v_2-v_{mod}| \quad \text{[Math. 1]}$$

where $v_1$ and $v_2$ are the first and second determined displacement speeds of the piston in the cylinder body and $v_{mod}$ is the predetermined or modeled displacement speed of the piston.

The integration is preferably done over a chosen time period, such that the comparison factor expresses a comparison of the first and second displacement speeds of the piston with the modeled displacement speed of the piston over said chosen time period. The use of the integral makes it possible to dispense with aberrant measurements and noise that can appear during the determination of said first and second displacement speeds of the piston. The accuracy of the comparison and therefore the identification of the most reliable position sensor are therefore improved.

The comparison factor is preferably retained in the memory.

Advantageously, the piston is configured to delimit a first chamber and a second chamber inside the piston body and the modeled displacement speed of the piston is a function of a modeled pressure difference between said first and second chambers.

If the cylinder is used as an actuator within a turbomachine comprising an injection chamber, the modeled pressure difference can be a function of a modeled flow rate of fuel injected into the combustion chamber of the turbomachine and also as a function of the pressure upstream of the combustion chamber.

Preferably, the modeled displacement speed of the piston is a function of a supply current of the servo valve. This current is also called the wrap current.

Advantageously, the modeled displacement speed of the piston is a function of an equilibrium current determined by applying a first-order filtering function to said supply current of the servo valve. The use of said equilibrium current makes it possible to obtain a particularly accurate model for the displacement speed of the piston.

The modeled displacement speed of the piston is preferably determined according to the following relationship:

$$v_{mod}=K\sqrt{|\Delta P|}(i-i_{eq}) \quad \text{[Math. 2]}$$

where i is the servo valve supply current, $i_{eq}$ is the equilibrium current, and ΔP is the modeled pressure difference between said first and second chambers. K is a gain that can be determined by linear regression on the basis of the modeled displacement speed of the piston, the supply current of the servo valve and said pressure difference.

Preferably, a prior step is performed of detecting the presence of at least one malfunctioning position sensor and the step is performed of comparing the first and second determined displacement speeds of the piston with the modeled or predetermined displacement speed of the piston when the presence of a malfunctioning position sensor is detected.

The term "malfunctioning" is understood to mean a position sensor for which the cylinder piston position measurements are particularly aberrant with respect to the actual position of the piston in the cylinder body and are therefore not satisfactory. It can in particular be a position sensor that is faulty, misadjusted or incorrectly calibrated. A fault in a position sensor generally leads to a drift in the position measurements that it provides.

The comparing step makes it possible to identify the position sensor supplying the piston position measurements that are the most accurate and the most consistent with the actual position of the piston in the cylinder body, out of the two position sensors. If one position sensor is malfunctioning while the other operates correctly, the position sensor operating correctly will be identified as being the most reliable. If both position sensors are malfunctioning, the least malfunctioning position sensor will be identified as being the most reliable.

The detecting step makes it possible to only perform the comparing step when a fault in one of the position sensors is detected. This makes it possible not to perform the comparing step constantly and to identify the most reliable position sensor only when this is necessary. One benefit is the savings in computation resources. Furthermore, the comparing step is only performed over a short time interval, facilitating the identification of the fault, on the basis of a small number of piston position measurements. The identification of the most reliable position sensor is improved.

Without limitation, the presence of a malfunctioning position sensor can be detected by observing particularly aberrant position measurements supplied by one of the position sensors or else by observing a malfunction or an incident in the control of the position of the cylinder piston. The detecting step advantageously makes it possible to detect a very slight malfunction or misadjustment of one of the sensors, for example low amplitude offsets or slow drifts.

Preferably, the presence of a malfunctioning position sensor is detected on the basis of the piston position measurements obtained with the first position sensor and with the second position sensor respectively. The presence of a malfunctioning position sensor is advantageously detected by observing a divergence between said piston position measurements supplied by the two position sensors.

Preferably, the step of detecting the presence of a malfunctioning position sensor comprises a step in which is determined the separation between the piston position measurements obtained with the first position sensor and the piston position measurements obtained with the second position sensor.

Advantageously, the step of detecting the presence of a malfunctioning position sensor further comprises steps in which the variance of said separation is computed and said variance is compared with a predetermined detection threshold. In the presence of a malfunctioning position sensor, for example with a fault, the position measurements it supplies drift just like said separation, more or less strongly. The variance of said separation, meanwhile, varies much more quickly and strongly and therefore makes it possible to detect more quickly a malfunctioning position sensor and therefore a malfunction, even slight, of the sensor.

The predetermined detection threshold is preferably chosen very low, in such a way as to detect very quickly the presence of a malfunctioning position sensor. This also makes it possible to detect a malfunction, even slight, of a position sensor, for example the presence of a slightly misadjusted position sensor. One benefit is that of allowing identification of the most reliable position sensor as soon as one of the position sensors is slightly malfunctioning. Detection is therefore accurate, owing to which the control of the cylinder is improved.

Preferably, a counter is initiated as soon as the presence of a malfunctioning position sensor is detected and the step of comparing the first and second determined displacement speeds of the piston with a modeled or predetermined displacement speed of the piston is stopped when the value of the counter is greater than a threshold of the counter. The value of the counter periodically increments from its initial value, for example every second. The counter threshold is set arbitrarily, for example to 30 seconds.

The use of the counter makes it possible to perform the comparing step over a limited time period, starting from the detection of a malfunctioning position sensor. This further facilitates the identification of the most reliable position sensor and reduces the resources involved in performing the step of comparing the first and second determined displacement speeds of the piston with the modeled or predetermined displacement speed of the piston.

Advantageously, the position sensor identified as being the most reliable is selected and the piston position is regulated using the piston position measurements supplied by said selected position sensor. One benefit is of slaving the piston position with accuracy, on the basis of the piston position measurements in the cylinder body which are the most accurate and consistent with the actual piston position. The regulation of the piston position is improved with respect to methods of the prior art making provision for regulation on the basis of the average of the position measurements supplied by all the position sensors. The regulation of the piston position is not affected in the event of a fault in one of the position sensors.

Preferably, a step is performed of additionally detecting the presence of a malfunctioning position sensor and a step of selecting the most reliable position sensor is performed if a malfunctioning position sensor has been detected during the step of additional detection. One benefit is that of making sure that a malfunctioning position sensor is present and not selecting a position sensor if all the position sensors are operating correctly. If no malfunctioning position sensor is detected during the step of additional detection, the position of the piston in the cylinder body will be regulated on the basis of the position measurements supplied by the set of position sensors.

In the embodiment in which the method comprises a prior detecting step, before the comparing step and serving as a condition for initiating said comparing step, the step of additional detection makes it possible to confirm the presence of a malfunctioning position sensor. Specifically, the prior detecting step, serving as a condition for initiating the comparing step, is preferably strict and can lead to the erroneous detection of a malfunctioning position sensor. The step of additional detection is preferably less strict and makes it possible to only detect a considerable malfunction of the position sensors and therefore to only take into account those position sensors that are actually malfunctioning. One benefit is that of making sure that a malfunctioning position sensor is present and only continuing to the step of selecting the most reliable sensor position when this has proven necessary.

Preferably, the step of additionally detecting the presence of a malfunctioning position sensor comprises a step of computing the separation between the position measurement positions obtained with the first position sensor and with the second position sensor respectively, and a step of selecting the most reliable position sensor is performed if the absolute value of said separation is greater than a predetermined additional detection threshold. The presence of a malfunctioning position sensor is therefore detected when the piston position measurements supplied by the two position sensors are strongly divergent.

The predetermined step of additional detection is preferably set to a sufficiently high value for the selecting step to only be performed when the separation between the position measurements obtained with the two position sensors is particularly large, expressing a considerable malfunction or measurement inaccuracy of one of the position sensors. Below the predetermined additional detection threshold, it is considered that no position sensor is malfunctioning and the step of selecting the most reliable position sensor is not performed.

The invention also relates to a device for controlling a cylinder comprising a cylinder body and a piston translationally movable inside the cylinder body, the control device comprising:

- a servo valve configured to regulate the power supplied to the cylinder, in such way as to control the position of the piston in the cylinder body;
- a measuring device comprising at least one first position sensor and one second position sensor, the position sensor being configured to simultaneously take measurements of the piston position in the cylinder body; and
- a processing module configured to determine at least one first displacement speed of the piston on the basis of the piston position measurements obtained with the first position sensor and configured to determine at least one second displacement speed of the piston on the basis of the piston position measurements obtained with the second position sensor, the processing module being configured to compare said first and second determined displacement speeds of the piston with a modeled or predetermined displacement speed of the piston.

The processing module advantageously comprises a module for determining the speed of the piston configured for determining said first and second displacement speeds of the piston and a comparing module configured to compare said first and second determined displacement speeds of the piston with the modeled or predetermined displacement speed of the piston.

BRIEF DESCRIPTION OF THE DRAWINGS

The invention will be better understood on reading the following description of an embodiment of the invention given by way of non-limiting example, with reference to the appended drawings, wherein.

DESCRIPTION OF THE EMBODIMENTS

The invention relates to a method for controlling a cylinder as well as to a device for controlling a cylinder, making it possible to implement the method. This control method makes it possible to identify the most reliable position sensor from among a set of position sensors and to control the position of the cylinder piston using the piston position measurements supplied by this position sensor.

Using FIGS. 1 to 3, a device for controlling a cylinder will now be described, in accordance with the present invention, allowing the implementation of a method for controlling a cylinder according to the invention.

In this non-limiting example, the cylinder is used to actuate variable-shimming blades in a compressor, forming movable members of a turbomachine. The turbomachine conventionally comprises a combustion chamber.

Figure 1:
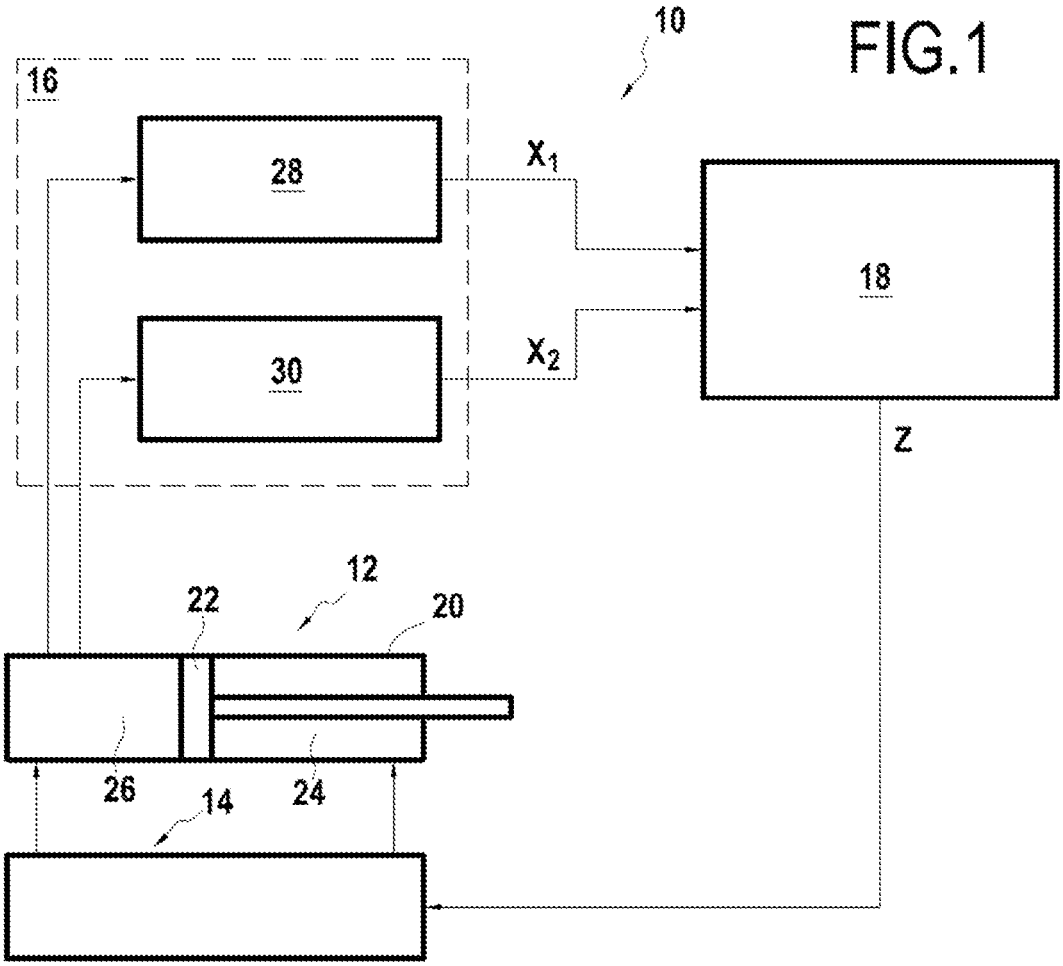
FIG. 1 illustrates a control device according to the invention.

FIG. 1 illustrates a device 10 for controlling a cylinder 12 in accordance with the present invention. The control device 10 comprises a servo valve 14, a measuring device 16 and a processing module 18.

The cylinder 12 comprises a cylinder body 20 and a piston 22 translationally movable inside the cylinder body. The piston delimits a first chamber 24 and a second chamber 26 inside the cylinder body 20. Without limitation, the cylinder is a double-acting cylinder, such that it is displaced in the cylinder body 20 as a function of the pressure of fluid present in the first and second chambers 24,26.

The servo valve 14 is a control valve used to regulate the flow rate of fluid supplying the first and second chambers of the cylinder, as a function of an electronic command signal it receives as input. The servo valve 14 thus makes it possible to adjust the position of the piston 22 in the cylinder body 20, as a function of a setpoint position.

The measuring device 16 comprises a first position sensor 28 and a second position sensor 30, each being configured to measure the position and provide measurements of the position of the piston in the cylinder body.

Figure 2:
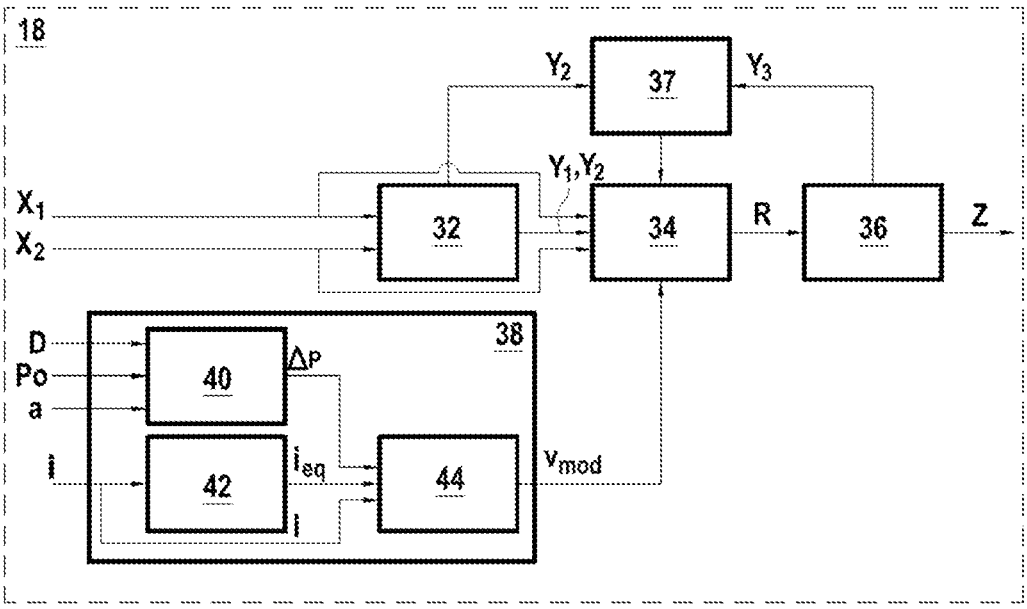
FIG. 2 illustrates a processing module of the control device of FIG. 1.

As illustrated in FIG. 2, the processing device 18 comprises a detecting module 32 configured to detect the presence of a malfunctioning position sensor, an identifying module 34 configured to identify the most reliable position sensor and a selecting module 36 configured to select the most reliable position sensor and control the regulation of the piston position on the basis of the position measurements obtained by said selected position sensor. The processing device comprises 37 a resetting module.

It can be seen that the processing device 18 also comprises a module 38 for determining a modeled speed configured to determine a modeled displacement speed $v_{mod}$ of the piston in the body 20 of the cylinder 12. The module for determining a modeled speed 38 comprises a module 40 for estimating a pressure difference, a module 42 for determining an equilibrium current and a computer 44. The module 40 for estimating a pressure difference is configured to determine a pressure difference $\Delta P$ between the first and second chambers 24,26 of the cylinder 20.

Figure 3:
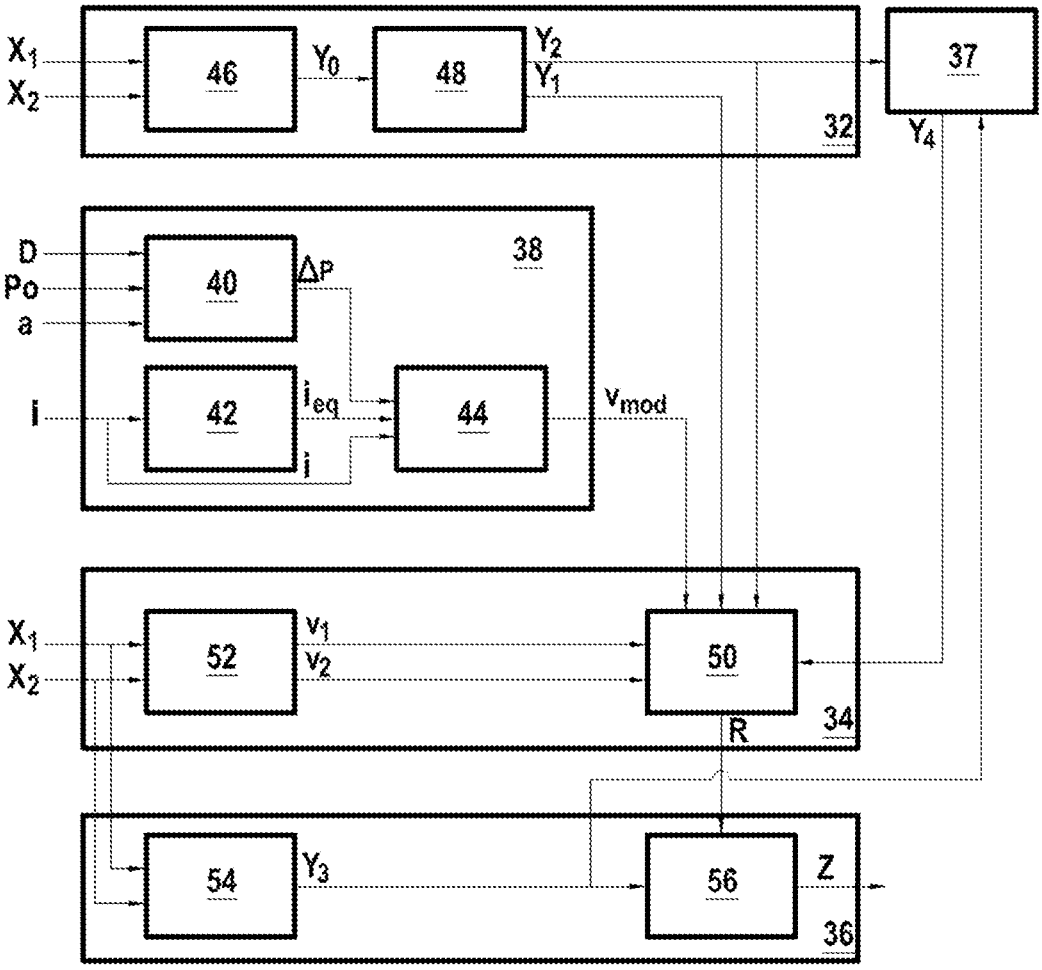
FIG. 3 is a detail view of the processing module of FIG. 2.

As illustrated in FIG. 3, the detecting module 32 comprises an alerting module 46, configured to generate a detection signal $Y_0$, as well as a counter 48.

The identifying module 34 comprises a comparing module 50 and a module 52 for determining the piston speed, configured to determine a first displacement speed $v_1$ of the piston on the basis of the position measurements supplied by the first position sensor 28 and a second displacement speed $v_2$ of the piston in the cylinder body on the basis of the position measurements supplied by the second position sensor 30.

The module 36 for selecting the most reliable position sensor comprises an additional detecting module 54 and a controlling module 56.

The steps of the controlling method in accordance with the present invention, implemented by the controlling device 10, will now be described.

The device 10 for controlling the cylinder 12 makes it possible to slave in real time the position of the piston 22 in the cylinder body 20. In particular, the first and second position sensors 28,30 are configured to each supply measurements of the piston position. The servo valve 14 then controls the supply of fluid used to bring the piston to a setpoint position, as a function of the position measured by the position sensors.

Under normal operation, the first and second position sensors continuously and simultaneously measure the position of the piston in the cylinder body. The first position sensor 28 is used to obtain a plurality of first measurements $X_1$ of the position of the piston and the second position sensor 30 is used to obtain second measurements $X_2$ of the position of the piston. The position measurements $X_1$,$X_2$ obtained by each of the first and second position sensors 28,30 are supplied to the detecting module 32 and more precisely to the alerting module 46 of the detecting module.

The alerting module 46 is configured to determine in real time the separation between the first $X_1$ and second $X_2$ position measurements simultaneously obtained by the first and second position sensors and to compute the variance of said separation. The alerting module 46 then compares said variance with a predetermined detection threshold.

As long as said variance remains less than said predetermined detecting threshold, which expresses the absence of a malfunctioning position sensor, the alerting module 46 does not transmit any detection signal and the control of the cylinder is not affected.

It is now considered that the first position sensor 28 is faulty and therefore malfunctioning, such that the first position measurements $X_1$ that it supplies are inaccurate and diverge and are therefore distant from the actual position of the piston and second position measurements $X_2$ supplied by the second position sensor 30. In addition, the separation between the first and second position measurements $X_1$,$X_2$ varies rapidly and with a high amplitude.

The variance of said separation, computed by the alerting module 46, then exceeds the predetermined detecting threshold. This expresses the presence of a malfunctioning position sensor and the alerting module then transmits a detection signal $Y_0$ to the counter 48 set to an initial value.

The detection threshold is advantageously chosen low, in order to rapidly detect a malfunction, even slight, of one of the position sensors. By one example, a weak divergence of the position measurements $X_1$,$X_2$ obtained by one of the position sensors 28,30 will be detected.

On receiving the detection signal $Y_0$, the counter 48 initiates a count, during which the value of the counter is periodically incremented, and transmits an initiation signal $Y_1$ to the identifying module 34 and more precisely to the comparing module 50.

Meanwhile, the module 38 for determining a modeled speed determines in real time a modeled speed $v_{mod}$ of the piston 22 in the cylinder body 20, which it supplies to the comparing module 50.

To do this, the module 40 for estimating a pressure difference computes a pressure difference ΔP between the first chamber 24 and the second chamber 26 of the piston. This pressure difference is, without limitation, determined on the basis of the flow rate of injection of fuel D into the combustion chamber of the turbomachine, the pressure $P_0$ upstream of said combustion chamber and the speed of rotation a of the high-pressure body of the turbomachine.

The module 40 for estimating a pressure difference supplies said determined pressure difference ΔP to the computer 44.

The module 42 for determining an equilibrium current is configured to determine an equilibrium current $i_{eq}$ on the basis of a supply current i of the servo valve 14, also called a wrap current. When the position of the cylinder is constant or weakly variable, the equilibrium current $i_{eq}$ is determined by applying a first-order filter to said supply current i of the servo valve.

Without limitation, the module 42 for determining an equilibrium current is configured to determine the sliding variance of the position of the cylinder piston measured by one of the two position sensors. The module 42 for determining an equilibrium current is configured to maintain the value of the equilibrium current $i_{eq}$ constant when said sliding variance is greater than a sliding variance threshold, which is the manifestation of a sudden variation in the cylinder position.

The supply current of the servo valve i and the equilibrium current $i_{eq}$ are transmitted to the computer 44. The computer is configured to compute the modelled displacement speed $v_{mod}$ of the piston in the body 20 of the cylinder 12. Without limitation, this modeled displacement speed is computed according to the following equation:

$$v_{mod}=K\sqrt{|\Delta P|}(i-i_{eq}) \quad \text{[Math. 3]}$$

K is a gain that can be determined by linear regression on the basis of said modeled speed $v_{mod}$, the supply current of the servo valve i and the pressure difference ΔP between the first chamber 24 and the second chamber 26 of the piston. Said modeled speed $v_{mod}$ is transmitted to the comparing module 50.

Meanwhile, the module 52 for determining the piston speed of the identifying module 34 determines a first displacement speed $v_1$ of the piston on the basis of the first position measurements $X_1$ supplied by the first position sensor 28. It is understood that said first displacement speed $v_1$ of the piston is determined on the basis of a plurality of first piston 22 position measurements $X_1$ supplied by the first position sensor 28. The module 52 for determining the piston speed also determines a second displacement speed $v_2$ of the piston on the basis of the second position measurements $X_2$ supplied by the second position sensor 30.

The values of the first and second displacement speeds $v_1$,$v_2$ of the piston are transmitted to the comparing module 50 of the identifying module 34.

If no initiation signal $Y_1$ is received by the comparing module 50, the latter remains inactive.

On the other hand, as soon as an initiation signal $Y_1$ is received by the comparing module 50, the latter compares the first and second displacement speeds $v_1$,$v_2$ of the piston with the modeled speed $v_{mod}$ used as a reference value. To do this, the comparing module 50 computes a comparison factor R and determines the sign of said comparison factor R. The comparison factor R is computed according to the following equation:

$$R=\int|v_1-v_{mod}|-\int|v_2-v_{mod}| \quad \text{[Math. 4]}$$

The integrations are done over a chosen time period, for example 0.3 seconds, in order to reduce measurement noise. When the comparison factor R is positive, the first displacement speed $v_1$ of the piston, determined on the basis of the first position measurements $X_1$ obtained with the first position sensor 28, is further from the modeled speed $v_{mod}$ than the second displacement speed $v_2$ of the piston, determined on the basis of the second position measurements obtained with the second position sensor 30, over the chosen time period. This expresses the fact that the first displacement speed of the piston is less satisfactory than the second displacement speed of the piston, and that the second piston position measurements $X_2$ obtained with the second position sensor 30 are more accurate than the first piston position measurements $X_1$ obtained with the first position sensor 28.

A positive comparison factor R therefore indicates that the second position sensor 30 is more reliable than the first position sensor 28. Conversely, a negative comparison factor R expresses the fact that the position measurements obtained with the first position sensor are more accurate than those obtained with the second position sensor. The first position sensor is then considered as the most reliable.

In this example, it is considered that the first sensor is malfunctioning, and that the comparison factor R computed is therefore positive.

The comparing module 50 computes, updates in real time and stores in the memory the comparison factor R, as long as the value of the counter remains less than a predetermined counter value, for example 30 seconds. The comparing module transmits the comparison factor R, positive in this example, to the selecting module 36 and more accurately to the controlling module 56.

When the value of the counter 48 reaches the predetermined counter threshold, the counter transmits an end-of-comparison signal $Y_2$ to the comparing module 50 and to the resetting module 37. On receiving the end-of-comparison signal $Y_2$, the comparing module 50 stops the computation of the comparison factor R.

The comparing module 50 is therefore active only after receiving the initiation signal $Y_1$ and before receiving the end-of-comparison signal $Y_2$.

Alongside the detection of the presence of at least one malfunctioning position sensor performed by the detecting module 32, and the identification of the most reliable position sensor performed by the identifying module 34, the additional identifying module 54 of the selecting module 36 is configured to check and confirm the presence of a malfunctioning position sensor. To do this, the additional detecting module 54 computes in real time the absolute value of the separation between the first piston position measurements $X_1$ obtained with the first position sensor 28 and the second position measurements $X_2$ obtained with the second position sensor 30 and compares this absolute value with an additional detection threshold.

When said absolute value of the separation between the first and second position measurements is greater than said additional detection threshold, the additional detecting module 54 transmits an additional detection signal $Y_3$ to the controlling module 56 as well as to the resetting module 37. The additional detection threshold is preferably set to a high enough value for the transmission of the additional detection signal $Y_3$ to only occur when the position measurements obtained with the two position sensors are particularly different and inconsistent, expressing a considerable inaccuracy of measurement of one of the position sensors.

The transmission of the additional detection signal $Y_3$ makes it possible to confirm the presence of a malfunctioning position sensor and to make sure that the presence of a malfunctioning position sensor was not erroneously detected by the detecting module 32.

If no additional detection signal $Y_3$ is received by the controlling module 56, the presence of a malfunctioning position sensor is not confirmed and the controlling module 56 remains inactive.

On the other hand, when the controlling module 56 receives an additional detection signal $Y_3$, the presence of a malfunctioning position sensor is confirmed.

In this example, the first position measurements $X_1$ supplied by the first sensor 28 are particularly aberrant and distant from the second position measurements $X_2$ supplied by the second position sensor 30. Thus, the additional detection module 54 transmits the additional detection signal $Y_3$.

The controlling module 56 then selects the most reliable position sensor out of the first and second position sensor 28,30, on the basis of the comparison factor R. In this example the comparison factor R is positive so the second sensor 30 is selected as being the most reliable. The controlling module 56 then transmits a command signal Z, particularly to the servo valve, in order to select the most reliable position sensor, in this case the second sensor 30, and control the regulation of the position of the piston 22 in the body 20 of the cylinder 12 solely on the basis of the position measurements obtained with the selected position sensor.

The step of selecting the most reliable position sensor is therefore carried out only when the presence of a malfunctioning position sensor is confirmed by the additional detection module 54.

If an end-of-comparison signal $Y_2$ is transmitted to the resetting module 37 but no additional detection signal $Y_3$ is transmitted to it, the resetting module 37 transmits a resetting signal $Y_4$ to the comparing module 50. This expresses the erroneous detection of a malfunctioning position sensor by the detecting module 32. On receiving the resetting signal $Y_4$ the comparing module 50 sets the value of the comparison factor R to a chosen initial value, for example 0. On the other hand, if it receives an additional detection signal $Y_3$, the resetting module 37 remains inactive.

Figure 4:
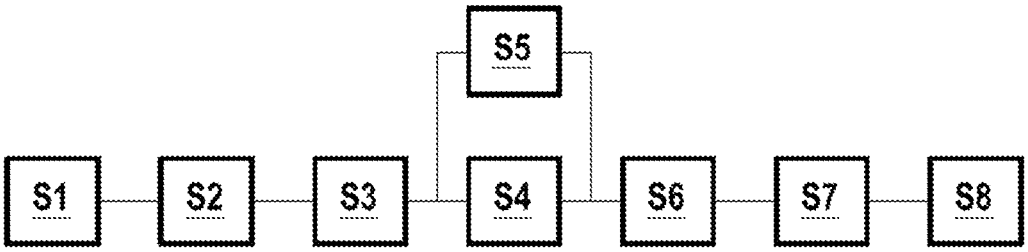
FIG. 4 illustrates the steps of the method for controlling a cylinder according to the invention.

FIG. 4 illustrates the steps of a method for implementing the method for controlling a cylinder according to the invention. This method can be implemented by the controlling device illustrated in FIGS. 1 to 3. First of all, in a first step S1, piston position measurements are taken in the cylinder body simultaneously with the first position sensor and the second position sensor. In a second step S2, a first displacement speed of the piston is determined on the basis of the piston position measurements obtained with the first position sensor and a second displacement speed of the piston is determined on the basis of the piston position measurements obtained with the second position sensor.

Next is performed a third step S3 of detecting the presence of at least one malfunctioning position sensor on the basis of the piston position measurements obtained with the first position sensor and with the second position sensor respectively. Without limitation, this third detecting step S3 comprises the steps in which the separation is determined between the piston position measurements obtained with the first position sensor and the piston position measurements obtained with the second position sensor, the variance of said separation is computed and said variance is compared with a predetermined detection threshold.

If a malfunctioning position sensor is detected, a fourth step S4 is performed of comparing each of the first and second determined displacement speeds of the piston with a modeled or predetermined displacement speed of the piston, in such a way as to identify the most reliable position sensor.

Alongside the fourth comparing step S4 a fifth step S5 of initiating a counter is performed. The fourth comparing step S4 is performed until the value of the counter exceeds a counter threshold.

Next a sixth step S6 is performed of additionally detecting the presence of a malfunctioning position sensor. This step comprises a step of computing the separation between the piston position measurements obtained with the first position sensor and with the second position sensor respectively and the absolute value of said separation is compared with a predetermined additional detection threshold.

If the absolute value of said separation is greater than the predetermined additional detection threshold, the presence of a malfunctioning position sensor is confirmed and a seventh step S7 is performed of selecting the position sensor identified as being the most reliable.

Next is performed an eighth step S8 of regulating the position of the piston using the piston position measurements supplied by said selected position sensor.

The invention claimed is:

1. A method for controlling a cylinder, comprising steps in which:

a cylinder is provided comprising a cylinder body and a piston translationally movable inside the cylinder body;

a servo valve is provided, configured to regulate the power supplied to said cylinder, in such a way as to control the position of the piston in the cylinder body;

a measuring device is provided comprising at least one first position sensor (28) and one second position sensor;

measurements are taken of the position of the piston in the cylinder body simultaneously with the first position sensor and the second position sensor;

at least one first displacement speed of the piston is determined on the basis of the piston position measurements obtained with the first position sensor;

at least one second displacement speed of the piston is determined on the basis of the piston position measurements obtained with the second position sensor;

the presence of at least one malfunctioning position sensor is detected; then when the presence of a malfunctioning position sensor is detected, each of the first and second determined displacement speeds of the piston are compared with a modelled or predetermined displacement speed of the piston, in such a way as to identify the most reliable position sensor, and a counter is initiated as soon as the presence of a malfunctioning position sensor is detected and the step of comparing the first and second determined displacement speeds of the piston with a modeled or predetermined displacement speed of the piston is stopped when the value of the counter is greater than a threshold of the counter.

2. The controlling method as claimed in claim 1, wherein the comparison of said first and second determined displacement speeds of the piston with said modeled displacement speed of the piston comprises a step of computing a comparison factor R and determining the sign of said comparison factor.

3. The controlling method as claimed in claim 2, wherein the comparison factor R is computed according to the following equation:

$$R=f|v_1-v_{mod}|-f|v_2-v_{mod}|$$

where $v_1$ and $v_2$ are the first and second determined displacement speeds of the piston and $v_{mod}$ is the modeled displacement speed of the piston.

4. The controlling method as claimed in claim 1, wherein the piston is configured to delimit a first chamber and a second chamber inside the piston body and wherein the modeled displacement speed of the piston is a function of a modeled pressure difference between said first and second chambers.

5. The controlling method as claimed in claim 1, wherein the modeled displacement speed of the piston is a function of a supply current of the servo valve.

6. The controlling method as claimed in claim 5, wherein the modeled displacement speed of the piston is a function of an equilibrium current determined by applying a first-order filtering function to said supply current of the servo valve.

7. The controlling method as claimed in claim 1, wherein the presence of a malfunctioning position sensor is detected on the basis of the piston position measurements obtained with the first position sensor and with the second position sensor respectively.

8. The controlling method as claimed in claim 7, wherein the step of detecting the presence of a malfunctioning position sensor comprises a step in which is determined the separation between the piston position measurements obtained with the first position sensor and the piston position measurements obtained with the second position sensor.

9. The controlling method as claimed in claim 8, wherein the step of detecting the presence of a malfunctioning position sensor further comprises steps in which the variance of said separation is computed and said variance is compared with a predetermined detection threshold.

10. The controlling method as claimed in claim 1, wherein the position sensor identified as being the most reliable is selected and the piston position is regulated using the piston position measurements supplied by said selected position sensor.

11. The controlling method as claimed in claim 10, wherein a step is performed of additionally detecting the presence of a malfunctioning position sensor and the step of selecting the most reliable position sensor is performed if a malfunctioning position sensor has been detected during the step of additional detection.

12. The controlling method as claimed in claim 11, wherein the step of additionally detecting the presence of a malfunctioning position sensor comprises a step of computing the separation between the position measurement positions obtained with the first position sensor and with the second position sensor respectively and wherein a step of selecting the most reliable position sensor is performed if the absolute value of said separation is greater than a predetermined additional detection threshold.

13. A device for controlling a cylinder comprising a cylinder body and a piston translationally movable inside the cylinder body, the control device comprising:

a servo valve configured to regulate the power supplied to the cylinder, in such way as to control the position of the piston in the cylinder body;

a measuring device comprising at least one first position sensor and one second position sensor, the position sensor being configured to simultaneously take measurements of the piston position in the cylinder body; and a processing module configured to determine at least one first displacement speed of the piston on the basis of the piston position measurements obtained with the first position sensor and configured to determine at least one second displacement speed of the piston on the basis of the piston position measurements obtained with the second position sensor, the processing module being configured to compare said first and second determined displacement speeds of the piston with a modeled or predetermined displacement speed of the piston, when the presence of a malfunctioning position sensor is detected, the processing module comprising a detecting module, the detecting module comprising a counter configured to be initiated as soon as the presence of a malfunctioning position sensor is detected and configured to transmit an end-of-comparison signal to stop the comparison of the first and second determined displacement speeds of the piston with a modeled or predetermined displacement speed of the piston when the value of the counter is greater than a threshold of the counter.

14. A method for controlling a cylinder, comprising steps in which:

a cylinder is provided comprising a cylinder body and a piston translationally movable inside the cylinder body;

a servo valve is provided, configured to regulate the power supplied to said cylinder, in such a way as to control the position of the piston in the cylinder body;

a measuring device is provided comprising at least one first position sensor (28) and one second position sensor;

measurements are taken of the position of the piston in the cylinder body simultaneously with the first position sensor and the second position sensor;

at least one first displacement speed of the piston is determined on the basis of the piston position measurements obtained with the first position sensor;

at least one second displacement speed of the piston is determined on the basis of the piston position measurements obtained with the second position sensor;

the presence of at least one malfunctioning position sensor is detected; then when the presence of a malfunctioning position sensor is detected, each of the first and second determined displacement speeds of the piston are compared with a modelled or predetermined displacement speed of the piston, in such a way as to identify the most reliable position sensor, wherein the position sensor identified as being the most reliable is selected and the piston position is regulated using the piston position measurements supplied by said selected position sensor, wherein a step is performed of additionally detecting the presence of a malfunctioning position sensor and the step of selecting the most reliable position sensor is performed if a malfunctioning position sensor has been detected during the step of additional detection, wherein the step of additionally detecting the presence of a malfunctioning position sensor comprises a step of computing the separation between the position measurement positions obtained with the first position sensor and with the second position sensor respectively and wherein a step of selecting the most reliable position sensor is performed if the absolute value of said separation is greater than a predetermined additional detection threshold.

* * * * *